US005161400A

United States Patent [19]

Lefor

[11] Patent Number: 5,161,400

[45] Date of Patent: Nov. 10, 1992

[54] PROCESS FOR LEVELLING CONTINUOUSLY MOVING METAL STRIPS

[75] Inventor: Karl Lefor, Hemer, Fed. Rep. of Germany

[73] Assignee: Sundwiger Eisenhütte Maschinenfabrik, Hemer-Sundwig, Fed. Rep. of Germany

[21] Appl. No.: 738,838

[22] Filed: Aug. 1, 1991

[30] Foreign Application Priority Data

Aug. 4, 1990 [DE] Fed. Rep. of Germany ..... 4024794

[51] Int. Cl.[5] ..... B21D 1/05

[52] U.S. Cl. ..... 72/161; 72/205

[58] Field of Search ..... 72/161, 160, 205, 164

[56] References Cited

U.S. PATENT DOCUMENTS 3,924,428 12/1975 Noe ..... 72/205

4,819,470 4/1989 Noe ..... 72/205

FOREIGN PATENT DOCUMENTS 0298852 9/1990 European Pat. Off. .

3525343 12/1986 Fed. Rep. of Germany .

1219967 1/1971 United Kingdom ..... 72/205

*Primary Examiner*—Daniel C. Crane

*Attorney, Agent, or Firm*—Marmorek, Guttman & Rubenstein

[57] ABSTRACT

The invention relates to a process for levelling continuously moving metal strips exclusively by tensile rolling levelling. The strip to be levelled is subjected to two successive tensile rolling operations in the direction in which it moves. In the first tensile rolling operation the tensile rolling levelling is performed with relatively low tensile stressing and considerable rolling deformation, while over the second tensile rolling distance the strip is subjected to only slight bending with substantially higher tensile stressing. The result of these successive different kinds of stretching-and-rolling levelling is a flat strip which maintains its flatness even after a prolonged storage period.

5 Claims, 1 Drawing Sheet

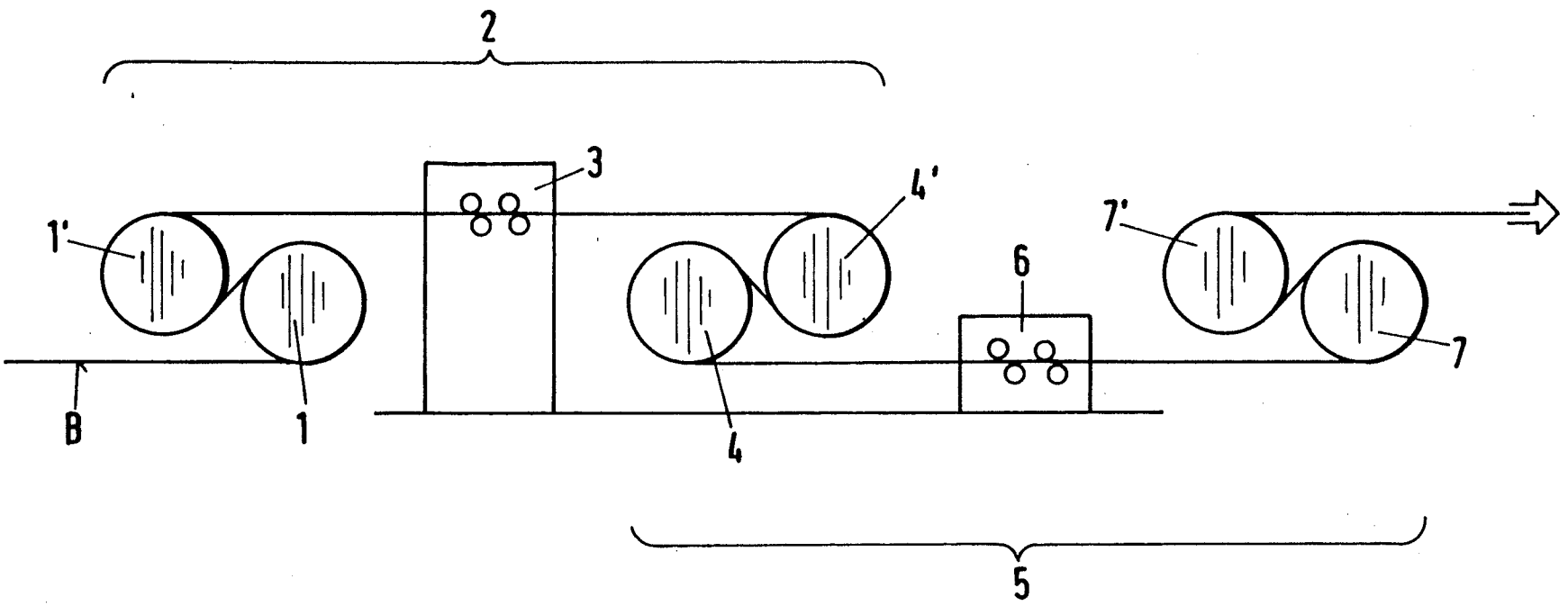
2
1'
1
B
3
4'
4
6
7'
7
5

PROCESS FOR LEVELLING CONTINUOUSLY MOVING METAL STRIPS

BACKGROUND OF THE INVENTION

Metal strips whose thickness has been reduced to less than 5 mm by multiple rolling are not flat. They are wavy and show bulges. For this reason they are frequently unsuitable for further processing. Such strips are therefore subjected to a levelling process. In levelling, a distinction is drawn between tensile stretching and stretching-and-rolling levelling (sometimes referred to herein as stretching-and-bending levelling or tensile rolling). In tensile stretching the strip is subjected to tensile stressing in which its yield point stressing is exceeded, so that the strip becomes plastically deformed, namely lengthened. In stretching-and-rolling levelling the strip is subjected to tensile stressing and bent several times under tension in opposite directions. In that case also the yield point stressing is exceeded in the zone of the bending in alternate directions, the strip becoming permanently lengthened. Lastly, it is also known to combine tensile stretching and stretching-and-rolling levelling with one another, stretching-and-rolling levelling being performed first, followed by tensile stretching. In any case, in that prior art tensile stressing is considered necessary if stretching-and-rolling levelling is performed with a degree of stretching $>1\%$, since then allegedly due to residual stresses in the strip bulging occurs in the strip and must be eliminated by the following purely tensile stretching in the plastic zone (DE 35 25 343 C1). In practice the various levelling processes, whether purely tensile stretching, or stretching-and-rolling levelling, or combined stretching-and-bending levelling and tensile stretching, are unsatisfactory not only because the strip lacks satisfactory flatness after the treatment, but more particularly because the sheet again loses its flatness after a prolonged storage period.

There is also the aspect that in the case of purely tensile stretching and also in combined stretching levelling and tensile stretching no clearly-defined strip stretching can be ensured over a strip width over the purely tensile distance. Since the strip is placed under tension between two tensioning drums, it cannot be readily stated in which zone of the tensioning distance the strip stretching (lengthening) takes place. If the tensioning distance is defined as the distance between the centre points of the two tensioning rollers, the required strip lengthening will not take place in said zone, but it must be assumed that the stretching zone lies immediately before and after the vertex of the two tensioning rollers respectively. The required strip lengthening therefore takes place on the contact arc of the tensioning rollers, namely immediately before a run-off point of the decelerating roller or immediately after the run-on point of the pulling roller, because the stress introduced into the strip at those places is higher than over the actual tensioning distance, since at that place a bending stress depending on the roller diameter is superimposed on—i.e., added to the tensile stress generated by the tensioning rollers.

The lengthening of the strip on the periphery of tensioning rollers causes considerable disadvantages. Since in practice such tensioning rollers always have a rubber coating, errors in the shaping of the rubberizing, different layer thicknesses and uneven wear on the coating and changing rubberizing properties produce in the strip a pattern of stresses which does not correspond to the pattern of internal stresses of the strip to be levelled. The result is a strip which due to these many imponderables has definite residual stresses and therefore inadequate flatness.

It is an object of the invention to develop a process which obviates the aforementioned disadvantages and by means of which not only can a flat strip be produced, but also as a result of its treatment the strip remains permanently flat.

SUMMARY OF THE INVENTION

This problem is solved by the process according to the invention by the features that in one pass the metal strip is subjected to tensile rolling twice with different tensile stressing, the bending deformation in the first tensile rolling operation being greater than in the second tensile rolling operation, and the tensile stressing in the second tensile rolling operation being at least 50% of the yield point stressing of the strip and greater than the tensile stressing during the first tensile rolling operation.

In direct contrast with the prior art, which comprises tensile rolling stretching followed by exclusively tensile stretching, according to the invention tensile rolling stretching is performed twice in different conditions. It has been found that in the different tensile rolling conditions in the first and second tensile rolling operations the strip is absolutely flat when it leaves the second tensile rolling distance and is free from the bulging which it experiences due to the prior art tensile rolling treatment. This effect is due to the fact that in the second tensile rolling operation the required plastic deformation of the strip can be performed using the customary means for bending, such as roller levelling apparatuses with small radii of curvature of the levelling rollers, than over a purely tensile stretching distance. It is surprising that in this way not only does the strip retain the required flatness, but the flatness also remains permanently preserved.

Flatness and the maintenance of flatness have been found to be satisfactorily achieved with a tensile stressing of 20% to 50% of the yield point stressing of the strip during the first stretching-and-rolling operation and/or with a tensile stressing of about 80%–90% of the limit stressing of the strip during the second stretching-and-rolling operation.

Preferably the strip should be differentially lengthened over the two tensile bending distances, more particularly be lengthened more considerably in the first than in the second tensile bending distance.

BRIEF DESCRIPTION OF THE DRAWING

An embodiment of the invention will now be explained in greater detail with reference to the accompanying drawing, which is a diagrammatic side elevation of an apparatus for the levelling of continuously moving metal strips.

DETAILED DESCRIPTION OF THE INVENTION

The apparatus has two tensile rolling distances 2–5 disposed successively in the direction in which a strip B to be levelled runs. The strip B passes via a pair 1, 1' of S-rollers into a first tensile rolling distance 2 and via another pair 4, 4' of driven S-rollers into a second tensile rolling distance 5 and from thence via a third driven pair 7, 7' of S-rollers to a coiler (not shown). The drives of the pairs 1, 1'; 4, 4'; 7, 7' of S-rollers which are controlled for tensile stressing or degree of stretch. Disposed in each tensile bending distance 2, 5 is a roller levelling apparatus 3, 6 whose rollers of minor radius of curvature bend the strip B several times in opposite directions as it passes through.

In the apparatus illustrated the strip B is subjected over the first tensile rolling distance 2 to heavy bending deformation and low tensile stressing, and over the second tensile bending distance 5 to heavy tensile stressing and low bending deformation. In the first tensile rolling distance the tensile stressing is 20 to 50% and in the second tensile rolling distance 5 it is 50 to 90% of the yield limit stressing of the strip B. In dependence on the adjusted tensile stressing, a bending stressing leading to the required lengthening of the strip is superimposed on the tensile stressing by the adjustment of the levelling rollers of the apparatuses 3, 6. To enable the tensile stressing to be adjusted over the two tensile rolling distances 2, 5 independently of one another, the pair 4, 4' of S-rollers is driven and therefore exerts a tensile stressing decoupling action on the two tensile rolling distances 2, 5.

I claim:

1. A process for levelling a metal strip which is continuously moving along a direction, comprising passing said metal strip through a first levelling device comprising a first plurality of rollers arranged so as to define a first substantially flat path between said rollers, said metal strip passing between said rollers along said first path while under tension and being subjected to combined tensile stressing and bending along said first path, thereafter passing said metal strip through a second levelling device comprising a second plurality of rollers arranged so as to define a second substantially flat path, said metal strip passing between said second plurality of rollers along said second path while under tension and being subjected to combined tensile stressing and bending along said second path, said metal strip being bent more while passing along said first path in said first levelling device than when passing along said second path in said levelling device, said tensile stressing in said second levelling device being at least 50% of the yield point stressing of said metal strip and being greater than the tensile stressing in said first levelling device, said metal strip being stretched more in said first levelling device than in said second levelling device.

2. The process of claim 1 wherein said tensile stressing in said first levelling device is 20 to 50% of the yield point stressing of said metal strip.

3. The process of claim 1 wherein said tensile stressing in said second levelling device is less than 90% of the yield point stressing of said metal strip.

4. The process of claim 1 wherein said metal strip is bent in the same directions when it enters and exits said first and second paths of said first and second levelling devices.

5. The process of claim 1 wherein said metal strip is bent in opposite directions when it enters and exits said first and second paths of first and second levelling devices.

* * * * *